US008272107B2

(12) United States Patent
Turvey et al.

(10) Patent No.: US 8,272,107 B2
(45) Date of Patent: Sep. 25, 2012

(54) VACUUM-ACTUATED CLOSURE MECHANISM FOR A RESEALABLE POUCH

(75) Inventors: Robert R. Turvey, Sanford, MI (US); John O. McCree, Bay City, MI (US); Stephen M. Perkins, East Lansing, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 442 days.

(21) Appl. No.: 12/607,606

(22) Filed: Oct. 28, 2009

(65) Prior Publication Data

US 2011/0097018 A1 Apr. 28, 2011

(51) Int. Cl.
*B65D 33/01* (2006.01)
*B65D 33/24* (2006.01)

(52) U.S. Cl. ..... 24/30.5 R; 24/585.12; 383/44; 383/61.2; 383/100

(58) Field of Classification Search ..... 383/44, 383/100, 61.2, 61.3, 63, 64; 24/30.5 R, 399, 24/400, 585.12, DIG. 39, DIG. 40, DIG. 50
See application file for complete search history.

(56) References Cited

U.S. PATENT DOCUMENTS

| | | | | |
|---|---|---|---|---|
| 3,565,147 | A | 2/1971 | Ausnit | |
| 4,578,813 | A | 3/1986 | Ausnit | |
| 4,736,451 | A | 4/1988 | Ausnit | |
| 5,017,021 | A | 5/1991 | Simonsen et al. | |
| 5,140,727 | A | 8/1992 | Dais et al. | |
| RE34,554 | E | 3/1994 | Ausnit | |
| 5,403,094 | A * | 4/1995 | Tomic | 383/63 |
| 6,299,353 | B1 | 10/2001 | Piechocki et al. | |
| 6,691,383 | B2 | 2/2004 | Linton | |
| 6,692,147 | B2 | 2/2004 | Nelson | |
| 6,955,465 | B2 | 10/2005 | Machacek et al. | |
| 7,036,988 | B2 | 5/2006 | Olechowski | |
| 7,140,772 | B2 | 11/2006 | Bois et al. | |
| 7,189,001 | B2 | 3/2007 | Gerrits | |
| 7,322,747 | B2 | 1/2008 | Borchardt | |
| 7,377,015 | B2 | 5/2008 | Long et al. | |
| 7,437,805 | B2 * | 10/2008 | Berich | 24/399 |
| 8,061,898 | B2 * | 11/2011 | Pawloski et al. | 383/59 |
| 2004/0001651 | A1 | 1/2004 | Pawloski | |
| 2005/0244083 | A1 | 11/2005 | McMahon et al. | |
| 2008/0310771 | A1 * | 12/2008 | Dais et al. | 383/59 |

* cited by examiner

*Primary Examiner* — James Brittain

(57) ABSTRACT

A pouch comprises a first sidewall and a second sidewall forming an interior space therebetween, a resealable closure mechanism including a first and a second elongate closure profile, and a resilient profile extending from one of the first or second closure profiles and having at least one notch extending therethrough to allow the evacuation of air from the interior space.

18 Claims, 6 Drawing Sheets

VACUUM-ACTUATED CLOSURE MECHANISM FOR A RESEALABLE POUCH

CROSS REFERENCE TO RELATED APPLICATIONS

Not applicable.

REFERENCE REGARDING FEDERALLY SPONSORED RESEARCH OR DEVELOPMENT

Not applicable

SEQUENTIAL LISTING

Not applicable

FIELD OF THE INVENTION

The present disclosure generally relates to a vacuum-actuated closure mechanism for a resealable pouch, and more particularly, to such a closure mechanism including a resilient profile that acts as a valve for the pouch.

BACKGROUND

Resealable pouches in the form of thermoplastic bags have been developed of a type that includes one or more sets of closure profiles for maintaining the pouch in a sealed condition. Another set of pouch designs has been developed wherein each design includes one or more flaps or other structures that seal below the closure profiles in an attempt to render the pouch fluid-tight. These designs are usually intended for use with a cursor or slider that can be slid across the top of the bag to close same; however, such designs are not always effective and may not allow a vacuum to be drawn and maintained in the pouch. Another set of pouch designs utilizes one or more one-way valve(s) disposed in a sidewall and/or in a closure profile of the pouch. A manually-operated pump or other air removal device is placed in fluid communication with the valve(s) and operated to effectuate air removal from the pouch until a vacuum state is reached. The closure profiles of this type of pouch may be somewhat complex in design and may require careful design.

A thermal sealing apparatus may be utilized as part of the vacuum pump. The thermal sealing apparatus melts the sidewalls of the pouch together once the vacuum pump has removed the air from the interior of the pouch. This sealing arrangement suffers from the potential deficiency that liquid from the interior of the pouch may be pulled into the heat sealing area between the sidewalls by the air flow as the vacuum is drawn, which prevents the sidewalls from completely melting together. As a result, the seal may be compromised. Examples of at least some vacuum devices that may be suitable for use include U.S. Pat. Nos. D501,859, 4,164,111, 4,583,347, and 4,941,310, however, utilizing the present disclosure, the thermal sealing apparatuses of each of the aforementioned may not be necessary.

SUMMARY

According to one aspect of the present disclosure, a pouch comprises a first sidewall and a second sidewall forming an interior space therebetween, a resealable closure mechanism including first and second elongate closure profiles, and a resilient profile extending from one of the first or second closure profiles and having at least one notch or opening extending therethrough to allow the evacuation of air from the interior space.

According to another aspect of the present disclosure, a resealable elongate closure mechanism includes a first closure profile and a second closure profile disposed on first and second bases, respectively, a first member disposed at a first end of the first base and a second member disposed at a second end of the first base, wherein the first member and the second member both extend from the first base toward the second base, and a resilient profile extending from the first base, wherein the resilient profile comprises a planar structure having at least one air passage therethrough.

According to yet a further aspect of the present disclosure, a resealable pouch includes a first sidewall and a second sidewall forming a mouth therebetween and a sealable interior, a resealable elongate closure mechanism comprising a first and second closure profile disposed on first and second bases, respectively, extending across the first and second sidewalls, respectively, and a resilient profile extending from the first closure profile having a first position and a second position, wherein the tip of the resilient profile touches the second base when the resilient profile is in the first position and wherein the resilient profile deflects into the second position to create a substantially airtight seal in the sealable interior.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

While specific embodiments are discussed herein, it is understood that the present disclosure is to be considered only as an exemplification of the principles of the disclosure. For example, a closure mechanism may include "pinch and seal"

type closures and/or slider-type closures. Further, the closure mechanism may include interlocking male and female closure profiles; however, other types, sizes, and shapes of closure profiles may also or alternatively be used. Still further, the closure mechanism may be attached to the pouch in any suitable manner. Illustratively, the closure mechanism may be attached directly to the pouch sidewall or may be disposed on sections of closure strip that are adhered or otherwise sealed to the pouch sidewall using any number of methods including post-applied (e.g., by heat sealing), cast-integral, and hybrid methods of manufacturing. Therefore, the present disclosure is not intended to limit the disclosure to the embodiments illustrated.

Figure 1:
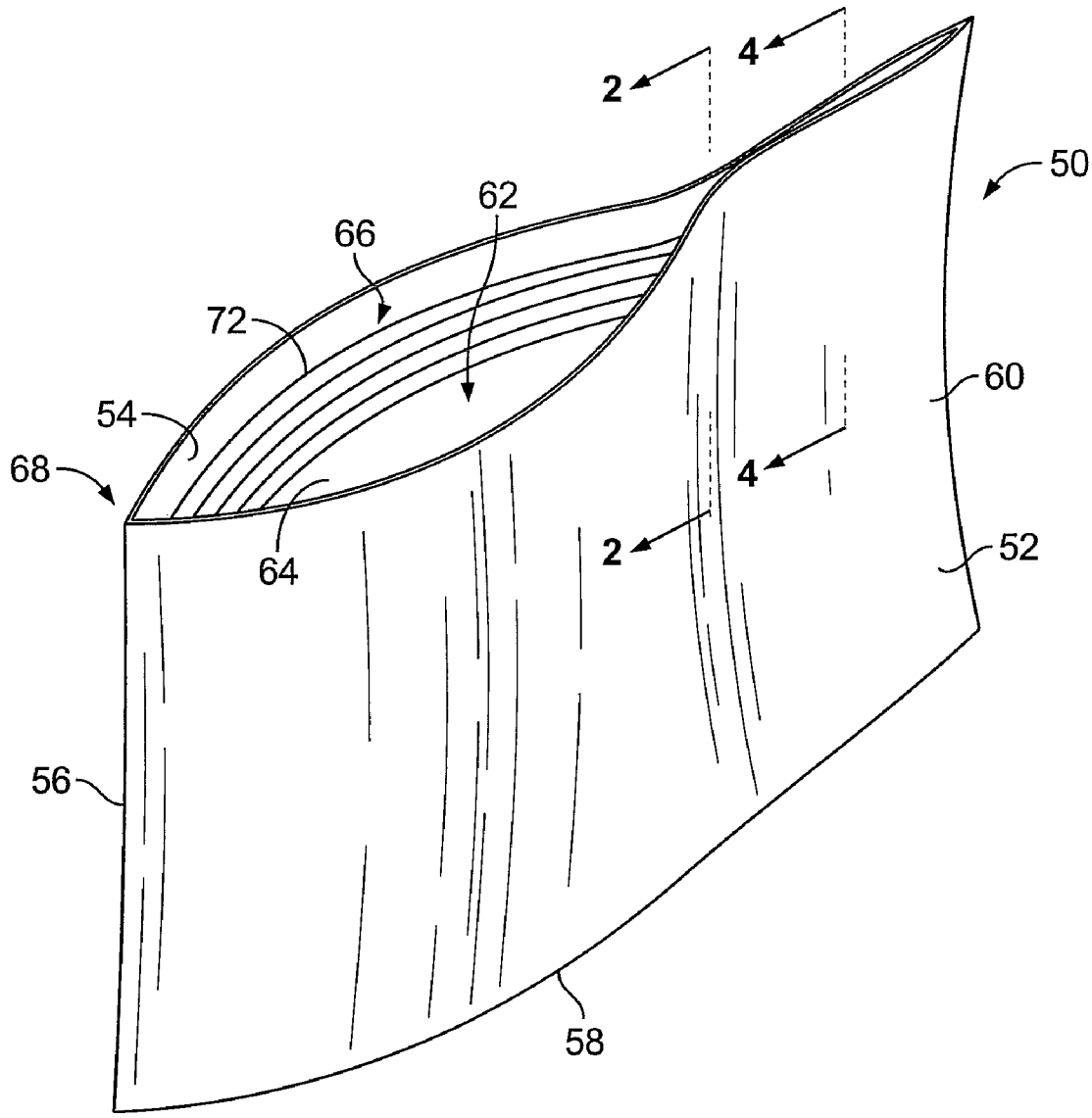
FIG. 1 is an isometric view of a pouch having a vacuum-actuated closure mechanism including a first and a second closure profile disposed along a top edge thereof.

FIG. 1 illustrates a reclosable pouch 50 having a first sidewall 52 and a second sidewall 54 that are connected by, for example, folding, heat sealing, and/or an adhesive, along three edges 56, 58, 60 to define an interior space 62 between the first and second sidewalls 52, 54. An opening 64 is located along a top edge 66 where the first and second sidewalls 52, 54 are not connected so as to allow access to the interior space 62. The pouch 50 may include one or more layers or embossed panels that form each of the first and second sidewalls 52, 54. In one embodiment, the first sidewall 52 includes a smooth film layer welded to an embossed film layer. Illustratively, suitable materials for use in the sidewalls include polyethylene, polypropylene, blends of such constituents, and the like. Such materials may include other additives as desired. Although the pouch 50 is generally depicted in FIG. 1. in a partly-occluded state, the pouch 50 of the present disclosure is preferably closed using a vacuum device, wherein the vacuum device preferably sealingly surrounds an entire portion of the opening 64. The reclosable pouch 50 may be of any kind that is well known in the art such as the type described in U.S. Patent Publication No. 2008/0232722.

A closure mechanism 68 extends longitudinally adjacent the top edge 66 and includes a first elongate closure profile 70 (not visible in FIG. 1, but visible in FIG. 4) and a second elongate closure profile 72. The first closure profile 70 is disposed along the first sidewall 52 near the opening 64 and extends between side edges 56, 60 of the pouch 50. The second closure profile 72 is disposed along the second sidewall 54 near the opening 64 and also extends between side edges 56, 60 of the pouch 50. Illustratively, each of the first and second closure profiles 70, 72 has a substantially constant elongate cross-sectional profile that extends fully between side edges 56, 60 of the pouch 50. The closure profiles 70, 72, are substantially aligned with each other on respective sidewalls 52, 54 such that the opening 64 may be repeatedly occluded and deoccluded, thereby respectively sealing and unsealing same.

Figure 2:
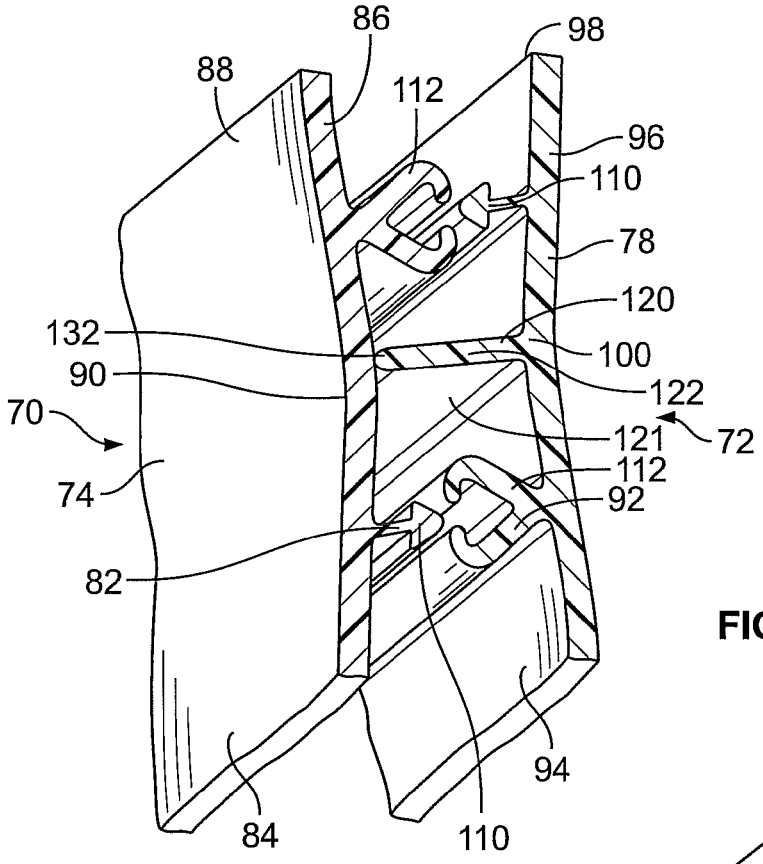
FIG. 2 is an isometric, fragmentary, sectional view of a portion of the closure profiles of FIG. 1 taken generally along the lines 2-2 of FIG. 1.
Figure 3:
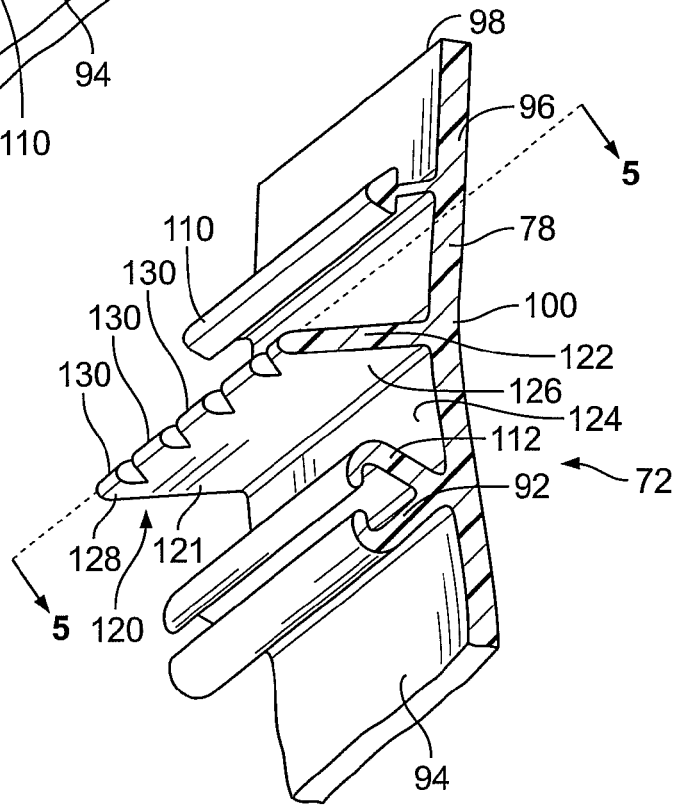
FIG. 3 is an isometric, fragmentary, sectional view similar to FIG. 2 of the closure mechanism of FIG. 1 with the first closure profile removed for clarity.
Figure 4:
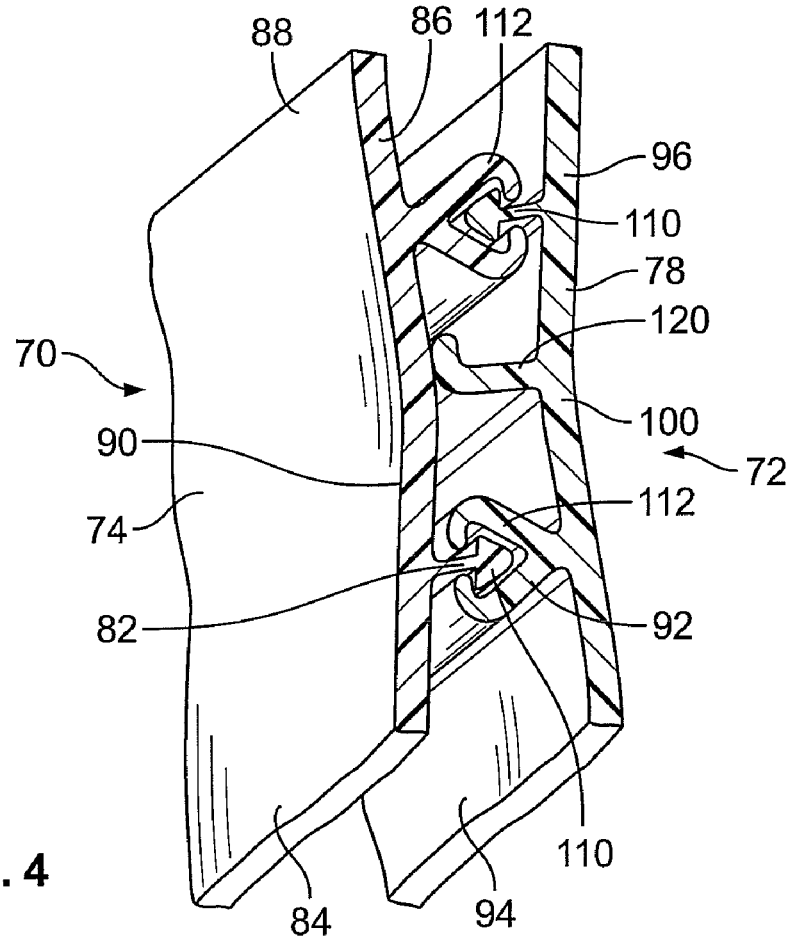
FIG. 4 is an isometric, fragmentary, sectional view of the closure profiles of FIG. 1 taken generally along the lines 4-4 of FIG. 1.

In one embodiment, as depicted in FIGS. 2-4, the first closure profile 70 includes a first base 74 adapted to be attached to an interior surface 76 of the first sidewall 52 and the second closure profile 72 includes a second base 78 adapted to be attached to an interior surface 80 of the second sidewall 54 (the sidewalls 52, 54 are not shown in FIGS. 2-4). In other embodiments, one or both of the first and second closure profiles 70, 72 may be integral with the respective first and second sidewalls 52, 54.

The first closure profile 70 includes a first member 82 disposed at a first end 84 of the first base 74, a second member 86 disposed at a second end 88 of the first base 74, and a medial portion 90 between the first member 82 and the second member 86. The first member 82 and second member 86 both extend from the first base 74 toward the second base 78. The second closure profile 72 includes a third member 92 disposed at a first end 94 of the second base 78, a fourth member 96 disposed at a second end 98 of the second base 78, and a medial portion 100 between the third member 92 and the fourth member 96. The third member 92 and fourth member 96 both extend from the second base 78 toward the first base 74 in a similar manner as the members of the first closure profile 70. Although two closure profiles are depicted each with two members disposed thereon and extending therefrom, it is contemplated that any number and combination of closure profiles and members may be used.

In one embodiment, the first member 82 comprises an arrow-shaped male closure 110 and the second member 86 comprises a female hook closure 112. The third member 92 comprises a female hook closure 112 and the fourth member 96 comprises an arrow-shaped male closure 110. The female hook closure 112 and the arrow-shaped male closure 110 of the first closure profile 70 are adapted to interlockingly engage with the arrow-shaped male closure 110 and female hook closure 112, respectively, of the second closure profile 72.

As shown in FIGS. 2 and 3, in a substantially undeflected position, a resilient profile 120 extends from the medial portion 100 of the second base 78 generally toward the medial portion 90 of the first base 74 preferably (but not necessarily) at a non-perpendicular angle with respect to the bases 74, 78. In one embodiment, the resilient profile 120 is a substantially planar structure 122 of substantially constant cross-sectional shape over substantially an entire length thereof (i.e., from one side edge 56 to the other side edge 60 of the pouch 50). However, it is also contemplated that the resilient profile 120 may have any shape as desired or as may aid in the manufacture and/or utility thereof. For example, the profile 120 may have a hollow, circular or elliptical shape, a wedge shape, or any other shape in cross-section. Although the resilient profile 120 is depicted as extending from the second base 78, the resilient profile 120 may instead, or in addition to, extend from the first base 74 toward the second base 78.

Figure 5A:
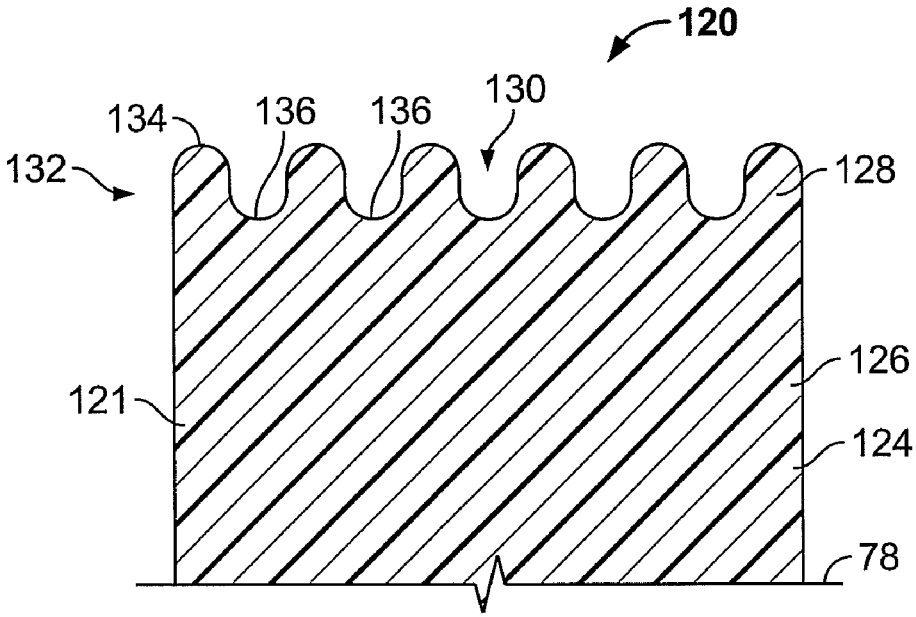
FIG. 5A is a cross-sectional view of one embodiment of a resilient profile, taken generally along the lines 5-5 of FIG. 3.
Figure 5B:
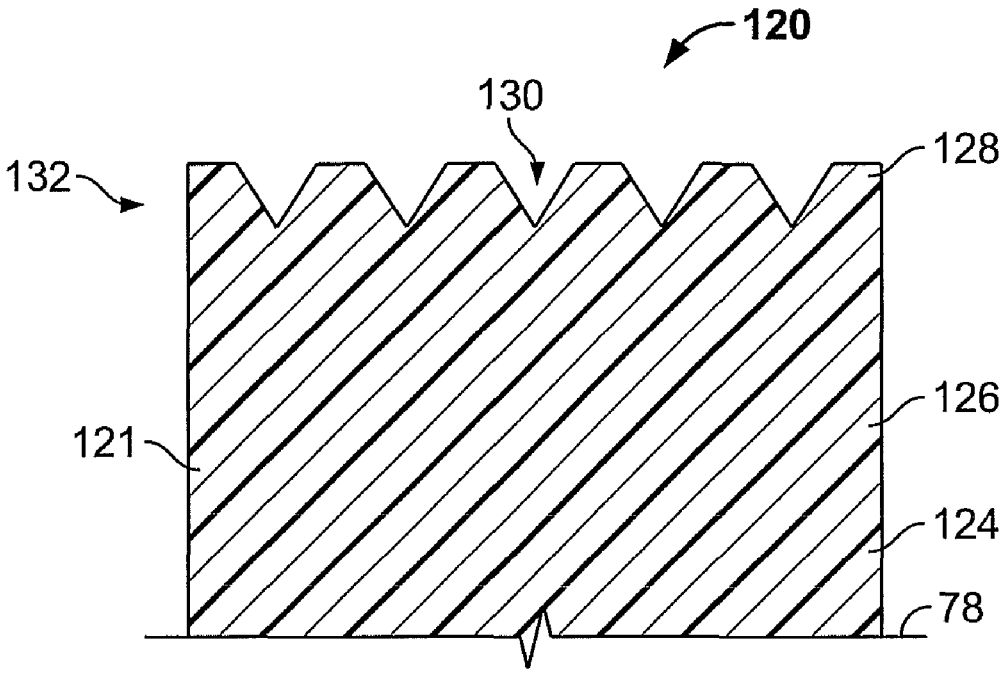
FIG. 5B is a cross-sectional view of a different embodiment of a resilient profile, taken generally along the lines 5-5 of FIG. 3.
Figure 5C:
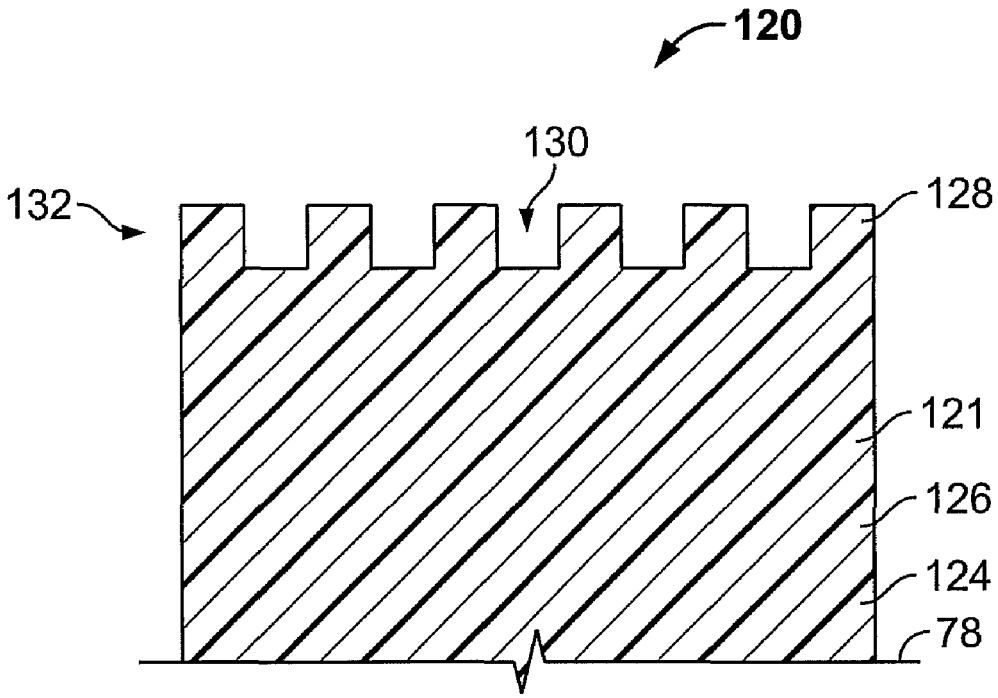
FIG. 5C is a cross-sectional view of a yet a different embodiment of a resilient profile, taken generally along the lines 5-5 of FIG. 3.

Referring to FIGS. 5A-5C, the resilient profile 120 includes a first end 124 attached to the second base 78, a main body 126, and a second end 128 disposed opposite the first end 124. One or more openings in the form of notches 130 are disposed at or near the second end 128 of the resilient profile 120. Preferably, each of the one or more notches 130 extends through the entire cross-sectional dimension of the resilient profile 120. Alternatively, one or more openings in the form of apertures may be provided extending fully through the main body 126 at any point thereof intermediate the ends 124, 128. The resilient profile 120 is preferably manufactured utilizing a similar material as that of the closure profiles 70, 72, for example, polyethylene and preferably includes a substantially smooth side surface 121. The smooth side surface 121 provides a better sealing interface between the resilient profile 120 and the medial portion 90 of the first base 74. Alternatively, the resilient profile 120 may be manufactured utilizing a different material and/or may have a varying cross-sectional thickness over the length thereof. In one embodiment, the resilient profile 120 may include tapered walls and/or sides bounding one or more of the openings.

As shown in FIG. 5A, in one embodiment, the plurality of notches 130 comprises generally U-shaped cutouts disposed through a tip 132 of the resilient profile 120. The notches 130 allow for the passage of air and/or liquid from the interior space 62 of the pouch 50 to an exterior portion of the pouch 50, as described in more detail herein. The notches 130 are preferably about 0 to about 70 thousandths of an inch deep and most preferably about 1 to about 20 thousandths of an inch deep in a direction extending from the second end 128 coincident with peaks 134 to bases 136 defining the notches 130. In a different embodiment depicted in FIG. 5B, the notches 130 are V-shaped cutouts. In yet a different embodiment shown in FIG. 5C, square-shaped cutouts are disposed at the tip 132 of the resilient profile 120. It is also contemplated that the notches 130 may be other shapes, sizes, and/or dimensions as well.

In one embodiment, the notches 130 are substantially similar in shape, for example, all U-shaped cutouts. In other embodiments, the notches 130 may include varying combinations of notches 130 having other shapes and sizes. Further, the notches 130 may be spaced at approximately equal distances from each other and/or may be spaced at other unequal intervals and/or combinations thereof. In other embodiments, the notches 130 may have beveled bases 136 and/or varying cross-sectional thickness(es) along a portion of the bases 136. In still different embodiments, the notches 130 are spaced relative to one another and disposed along the entire length of the resilient profile 120 from side edge 56 to side edge 60.

Figure 6:
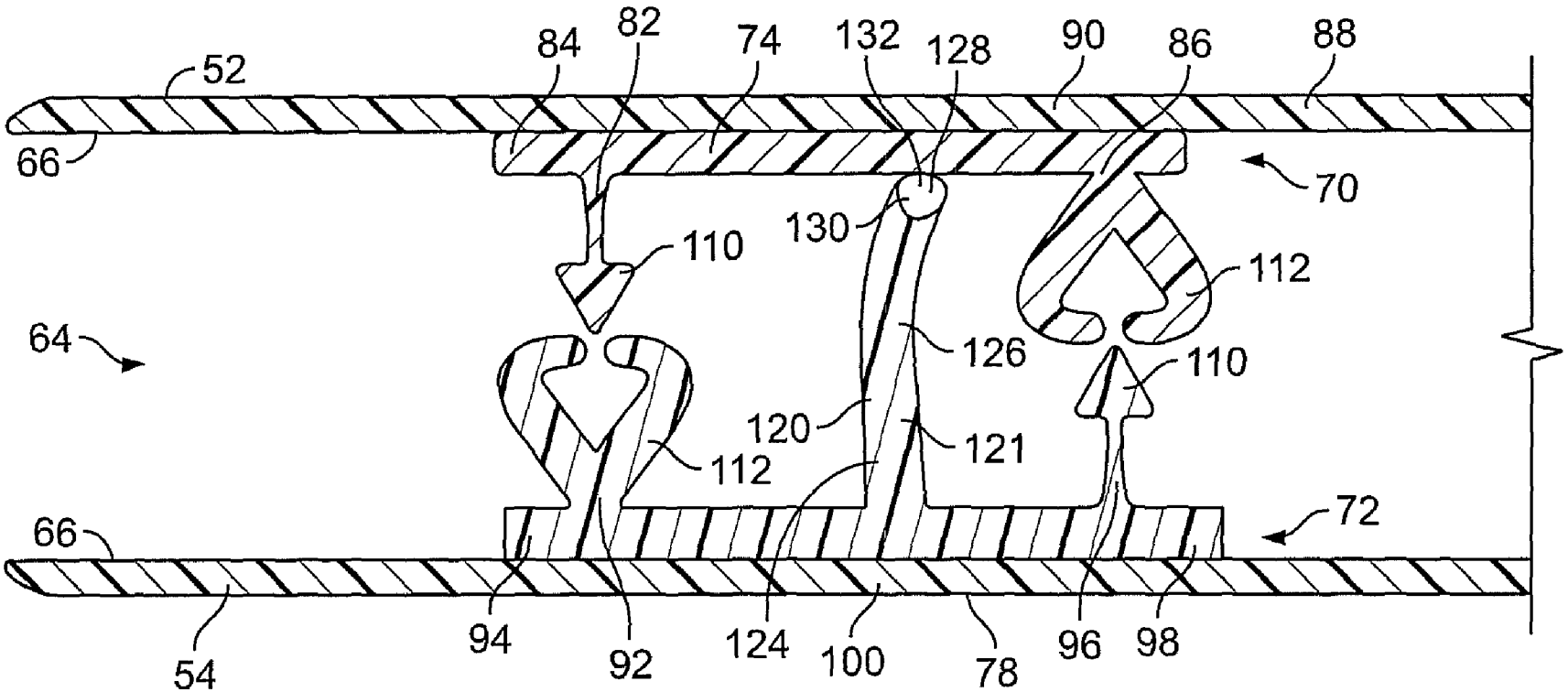
FIG. 6 is a cross-sectional view of a closure mechanism in a substantially undeflected position, taken generally along the lines 2-2 of FIG. 1, with portions behind the plane of the cross section omitted for clarity.
Figure 7:
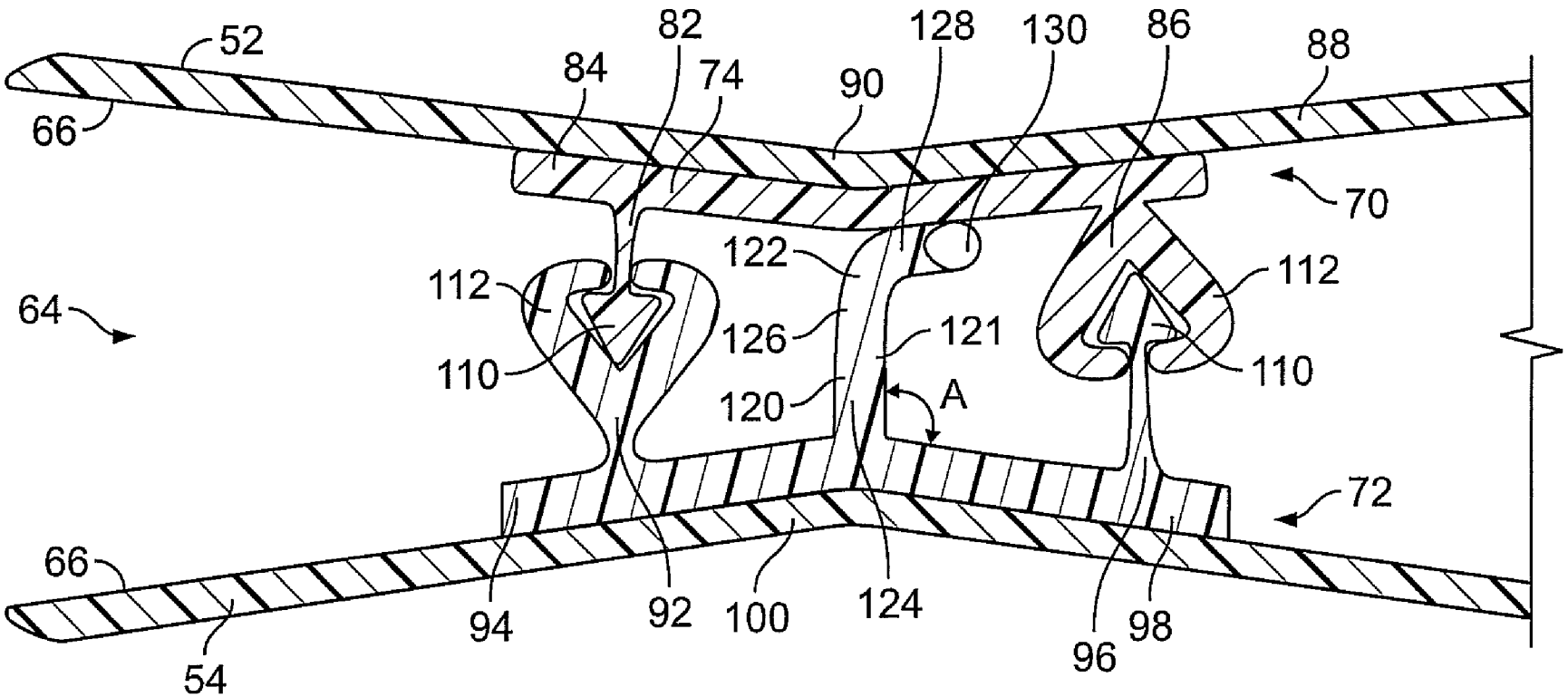
FIG. 7 is a cross-sectional view of the embodiment of FIG. 6 of the closure mechanism in a deflected position, taken generally along the lines 4-4 of FIG. 1, with portions behind the plane of the cross section omitted for clarity.

Turning to FIGS. 6 and 7, the resilient profile 120 extends from the second base 78 at an angle A. In one embodiment, the angle A is preferably about 20 degrees to about 90 degrees, and more preferably about 30 degrees to about 70 degrees, and most preferably about 50 degrees. The angle A of the resilient profile 120 should be selected such that the resilient profile 120 can readily hinge about the second base 78 when the pouch 50 is closed.

In use, food items or other materials (not shown) are inserted into the pouch 50 through the opening 64. As shown in FIGS. 2 and 6, the sidewalls 52, 54 may then be moved by a user toward a first position, wherein the tip 132 of the resilient profile 120 is touching the medial portion 90 of the first base 74. When the user is ready to close the pouch 50, the opening 64 of the pouch 50 is moved into a receiving slot of a vacuum device (not shown). The vacuum device is activated to remove air from the interior space 62 of the pouch 50. As air is removed from the pouch 50, the resilient profile 120 moves toward the first sidewall 52 such that the tip 132 touches the first base 74 (if the tip 132 was not already touching the first base 74 along the entire length of the profile 120). The notches 130 facilitate airflow therethrough from the interior space 62 to an external portion of the pouch 50. As best seen in FIGS. 4 and 7, the resilient profile 120 may deflect as air is removed from the pouch 50. In a deflected position, the notches 130 of the resilient profile 120 still allow for the evacuation of air therethrough until a desired level of vacuum is reached.

Any suitable vacuum device may be used to facilitate air removal from the pouch 50 including manually and automatically actuated devices. The vacuum device preferably supplies a sufficient pressure differential that pulls the first and second closure profiles 70, 72 toward each other into an occluded position (seen in FIGS. 4 and 7) without assistance from the user. During such occlusion, the female hook closure 112 and the arrow-shaped male closure 110 of the first closure profile 70 are urged toward the arrow-shaped male closure 110 and female hook closure 112, respectively, of the second closure profile 72 and the profiles engage to form a seal therebetween. As the pouch 50 is sealed, the resilient profile 120 acts as one-way valve to allow airflow in only one direction from the interior space 62 to the external portion of the pouch 50. One advantage of the present disclosure is that as the vacuum device is activated, the closures 110, 112 occlude independent of any outside pressure applied by a user and may be fully sealed by the vacuum applied by the vacuum device alone. As the closures 110, 112 are occluding, an audible noise is produced that allows the user to know that the closures 110, 112 are occluded.

Various details shown in FIGS. 1-7 may be modified as will be apparent to those of skill in the art without departing from the disclosed principles. Other methods and materials suitable for forming structures of the present disclosure may also be utilized.

INDUSTRIAL APPLICABILITY

A vacuum-actuated closure mechanism that may be used on reclosable flexible pouches has been presented. A resilient profile having at least one notch extending therethrough allows for the evacuation of air from an interior portion of the pouch.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same.

We claim:

1. A pouch comprising:

a first sidewall;

a second sidewall connected to the first sidewall to form an interior space therebetween;

a first closure profile extending from the first sidewall, the first closure profile including a first closure element and a second closure element;

a second closure profile extending from the second sidewall, the second closure profile including a first closure element and a second closure element; and a resilient profile extending from one of the first and second closure profiles, the resilient profile being positioned between the first and second closure elements of the one of the first and second closure profiles, the resilient profile having at least one opening extending through an entire cross section of the resilient profile.

2. The closure mechanism of claim 1, wherein the resilient profile comprises (i) a first end attached to a base portion of the first closure profile, (ii) a main body, and (iii) a second end disposed opposite to the first end.

3. The closure mechanism of claim 2, wherein the at least one opening includes a plurality of openings that are disposed at the second end of the resilient profile.

4. The closure mechanism of claim 3, wherein the openings comprise notches formed in the second end of the resilient profile.

5. The closure mechanism of claim 4, wherein the notches are U-shaped cutouts.

6. The closure mechanism of claim 5, wherein the first closure element of the first closure profile is a male closure element and the second closure element of the first closure profile is a female closure element.

7. The closure mechanism of claim 6, wherein the resilient profile extends at an angle from the base of the first closure profile.

8. A resealable elongate closure mechanism comprising:

a first closure profile provided on a base;

a second closure profile provided on a base;

a first member disposed at a first end of the base of the first closure profile and extending towards the base of the second closure profile;

a second member disposed at a second end of the base of the first closure profile and extending towards the base of the second closure profile; and a resilient profile extending from the first base, the resilient profile being positioned between the first and second members, and the resilient profile being a planar structure having at least one air passage through an entire cross section of the resilient profile.

9. The closure mechanism of claim 8, wherein the second closure profile includes a first member and a second member.

10. The closure mechanism 9, wherein the resilient profile extends from the first closure profile toward the second closure profile at a non-perpendicular angle.

11. The closure mechanism 10, wherein the at least one air passage includes a plurality of air passages formed as a plurality of notches extending through the resilient profile.

12. The closure mechanism of claim 11, wherein the notches are about one inch to about twenty thousandths of an inch deep in a direction extending from an end of the resilient profile.

13. The closure mechanism of claim 12, wherein the notches are substantially similar in shape.

14. A resealable pouch comprising:

a first sidewall;

a second sidewall connected to the first side wall to form a mouth therebetween and a sealable interior;

a resealable elongate closure mechanism including (i) a first closure profile disposed on a base and extending across the first sidewall, and (ii) a second closure profile disposed on a base and extending across the second sidewall; and a resilient profile extending from the first closure profile, the resilient profile being movable between a first position and a second position, the resilient profile including notches extending through a cross section of the resilient profile, wherein a tip of the resilient profile touches the base of the second closure profile when the resilient profile is in the first position, and the resilient profile deflects into the second position to create a substantially airtight seal in the sealable interior.

15. The resealable pouch of claim 14, wherein the resilient profile deflects as a vacuum force is applied from an external source and allows the passage of air therethough.

16. The resealable pouch of claim 15, wherein the resilient profile acts as a one-way valve, with the notches allowing airflow in only one direction from the sealable interior to an exterior of the pouch.

17. The resealable pouch of claim 16, wherein the resilient profile blocks the airflow at lateral edges when an external vacuum force is applied.

18. The reasealable pouch of claim 17, wherein the first and second closure profiles occlude when the external vacuum force is applied.

* * * * *